US005186871A

United States Patent [19]

Miehling

[11] Patent Number: 5,186,871

[45] Date of Patent: Feb. 16, 1993

[54] METHOD AND APPARATUS TO PREPARE MONOBASIC PROPELLANT CHARGE POWDERS WITH ALCOHOL AND ETHER AS SOLVENTS

[75] Inventor: Wolfgang Miehling, Mühldorf, Fed. Rep. of Germany

[73] Assignee: WNC-Nitrochemie GmbH, Aschau, Fed. Rep. of Germany

[21] Appl. No.: 634,161

[22] PCT Filed: Apr. 17, 1990

[86] PCT No.: PCT/EP90/00615

§ 371 Date: Dec. 13, 1990

§ 102(e) Date: Dec. 13, 1990

[87] PCT Pub. No.: WO90/12772

PCT Pub. Date: Nov. 1, 1990

[30] Foreign Application Priority Data

Apr. 25, 1989 [DE] Fed. Rep. of Germany ..... 3913603

[51] Int. Cl.[5] ..... C06B 21/00

[52] U.S. Cl. ..... 264/3.3

[58] Field of Search ..... 264/3.3

[56] References Cited

U.S. PATENT DOCUMENTS

| | | | |
|---|---|---|---|
| 3,855,373 | 12/1974 | Swotinsky et al. | 264/3.3 |
| 4,102,953 | 7/1978 | Johnson et al. | 264/3.3 |
| 4,120,920 | 10/1978 | Cougoul et al. | 264/3.1 |
| 4,298,552 | 11/1981 | Gimler | 264/3.3 |
| 4,326,901 | 4/1982 | Leneveu et al. | 264/3.3 X |

*Primary Examiner*—Peter A. Nelson

*Attorney, Agent, or Firm*—Lowe, Price, LeBlanc & Becker

[57] ABSTRACT

In a production of monobasic propellant charge powders with alcohol and ether as solvents there is the risk of ether bubbles forming in the propellant charge powder material, and those bubbles greatly reduce the quality of the propellant charge powder. The invention provides for cooling the propellant charge powder material prior to its leaving the extruder. To accomplish that, the extruder head (4) is provided with a cooling means. The invention is especially well suited for use in the preparation of monobasic propellant charge powders with alcohol and ether as solvents.

7 Claims, 3 Drawing Sheets

METHOD AND APPARATUS TO PREPARE MONOBASIC PROPELLANT CHARGE POWDERS WITH ALCOHOL AND ETHER AS SOLVENTS

The invention relates to a method of preparing monobasic propellant charge powders with alcohol and ether as solvents, making use of an extruder. It also relates to an apparatus for making monobasic propellant charge powders of the kind mentioned which apparatus comprises at least one screw supported in a housing and an extruder head, including at least one die, arranged at the discharge end of the housing and having a cooling means to cool the propellant charge powder mixture which is located at the discharge end.

It is known from the prior art to prepare propellant charge powders by resorting to an extruder DE-OS 32 42 301, for instance, discloses an apparatus with which the propellant charge powder material is mixed and kneaded by making use of a double shaft screw extruder. The apparatus comprises a cooling means to dissipate the heat resulting from the extrusion and to adjust a certain temperature profile in the powder mixture throughout the length which the mixture passes in the extruder. In the case of monobasic powders the temperature should be highest at the discharge end. An extruder comprising a cooling means for the production of propellant charge powders is known also from DE-OS 34 07 238.

The use of solvents is required in the preparation of monobasic propellant charge powders. Alcohol, acetone, and ether belong to the customary solvents chosen. The nitrocellulose used normally is moist with alcohol. Where monobasic propellant charge powders are prepared in the extruder so far only alcohol/acetone are added as solvents. Ether has a very low boiling point. Since heat is set free in the extruder, the ether may evaporate and, as a consequence, the powder mixture exiting from the extruder contains ether bubbles throughout. The ether bubbles disturb the homogeneity of the pulverous substance, result in a porous surface of the powder strands, and consequently yield a product of inadequate quality. Furthermore, the exiting ether-air mixture presents quite a considerable hazard. For this reason the use of alcohol/ether as solvents was precluded until now although these solvents do have marked advantages as compared to alcohol/acetone. For instance, it is much more difficult to remove acetone from the propellant charge mixture than ether. Longer drying times under vacuum and prolonged watering are needed, for example. Besides, monobasic propellant charge powders prepared with acetone have a tendency to be brittle when cold at temperatures below freezing.

It is, therefore, an object of the invention to indicate a method and an apparatus of the kind defined initially which, while being of simple structure and operationally safe to handle, permit the preparation of high-quality monobasic propellant charge powders with alcohol and ether as solvents by making use of an extruder.

The method according to the invention, devised to solve the problem posed, is characterized in that the pulverous substance is cooled before it leaves the extruder.

The method according to the invention has a number of distinct advantages. The occurrence of ether bubbles can be avoided reliably by the fact that the propellant charge powder is cooled before it is discharged from the extruder.

It must be taken into account with the method of the invention that part of the kneading energy in gelatinizing nitrocellulose is converted into heat. Therefore, the material in the extruder usually is heated to a temperature above the boiling point of ether (35° C.). If the formation of ether bubbles at the powder surface is to be avoided, the temperature of the propellant charge powder mixture having passed the die must not be much higher than the boiling point. In accordance with the invention only that part of the equipment is cooled at which the occurrence of ether bubbles is especially critical which is the outlet zone or discharge end of the extruder. In that area, therefore, the temperature of the pulverous mass is reduced to the boiling point of ether or below that point.

The invention is based on the finding that monobasic propellant charge powders which are gelatinized with ether differ distinctly from other plastic substances in the extruder, such as thermoplastic materials or polybasic propellant charge powder mixtures. With thermoplastics or polybasic propellant charge powder mixtures the viscosity depends greatly on the temperature, i.e. the flow behavior in the extruder varies with varying temperatures. With plastics of this kind, the temperature of the jacket member in the outlet region of the extruder must be adapted to the plastic melt in order to assure a constant temperature distribution over the entire cross sectional area so that inhomogeneities can be prevented and uniform flow behavior obtained.

Contrary to the above, it was found with the invention that the viscosity and thus also the flow behavior of propellant charge powder mixtures gelatinized with ether is practically independent of the temperature. For this reason the thermal energy may be withdrawn from these propellant charge powder mixtures by cooling during the extruding process, thereby creating a temperature gradient of such nature, both in radial and axial directions, that the boiling point of ether is not surpassed. This does not involve the risk of any inhomogeneities being formed or different flow behavior resulting with the pulverous substances.

It was further found in accordance with the invention that it is unnecessary to devise the whole extruding apparatus such that the propellant charge powder mixtures can be cooled down to a temperature below the boiling point of ether. Rather, it is sufficient to cool the propellant charge powder mixture before it leaves the extruder so that, upon passage of the dies, it will have a temperature equal to or lower than the boiling point of ether. The pressures prevailing in the other parts of the extruder reliably prevent the formation of ether bubbles.

With the method of the invention it is thus unnecessary to maintain a certain temperature gradient for the full length of passage through the apparatus, such as known for instance from DE-OS 32 42 301. In particular, it is not necessary to keep the temperature of the propellant charge powder mixture in the kneading and mixing areas of the extruder below the boiling point of ether.

According to an advantageous further development of the method of the invention the cooling is effected down to a temperature of from 35° to 40° C. This temperature corresponds to the boiling point of ether. It makes no difference if that temperature is not observed very strictly since ether bubbles will occur in minor amounts, if at all.

Moreover, it is especially advantageous with the method of the invention to operate the screw range of the extruder when filled as much as possible. That measure may be important in order to guarantee sufficient pressure of the propellant charge powder mixture in the extruder and to make sure that ether bubbles do not occur in those parts of the extruder which are not cooled. If the extruder is cooled also in the mixing and kneading regions, the total filling enhances the good heat transfer from the powder mixture to the extruder.

It is advantageous to process the propellant charge powder mixture or pulverous substance at a low rotational speed of the screw part of the extruder so as to limit the heating of the powder during the gelatinizing already. An increase in the number of revolutions, at otherwise constant conditions, would lead to an increase of the temperature of the product.

It is likewise especially advantageous with the invention to choose the alcohol content such that it will be within the range of from 25 to 30%. In the case of propellant charge powders having a high DNT content it is also possible, in accordance with the invention, to lower the alcohol content below 25%.

In another particularly advantageous embodiment of the method according to the invention, furthermore, the ether content is adjusted such that the pressure at the outlet area of the extruder will be from 30 to 35 bar.

When applying the method according to the invention, monobasic propellant charge powders can be gelatinized safely with ethers even if a relatively short extruder head is used.

A suitable apparatus for carrying out the method according to the invention is characterized in that a passage is provided between the end region of the screw and the die, and a cooling mandrel is arranged within the passage. Water or any other suitable fluid may be applied to the cooling mandrel. The cooling mandrel preferably is supported centrally in the passage.

Another advantage is achieved with the apparatus according to the invention if the discharge end of the housing is provided with a first cooling jacket surrounding the end region of the screw and the passage is provided with another cooling jacket. In this manner the latter part of the screw, as seen in the direction of passage of the material, is included in the cooling.

With the apparatus according to the invention the propellant charge powder can flow without disturbance through the passage and this means that temperature gradients can be set which are stable and calculable. The cooling mandrel accomplishes particularly intensive cooling of the powder mixture ahead of the die. The propellant charge powder mixture is cooled from within and from without (seen in radial direction) and therefore the propellant charge powder mixture entering the die is of uniform temperature in radial direction. The formation of individual overheated areas thus is prevented reliably.

The invention will be described further, by way of example, with reference to the accompanying drawings, in which.

Figure 1:
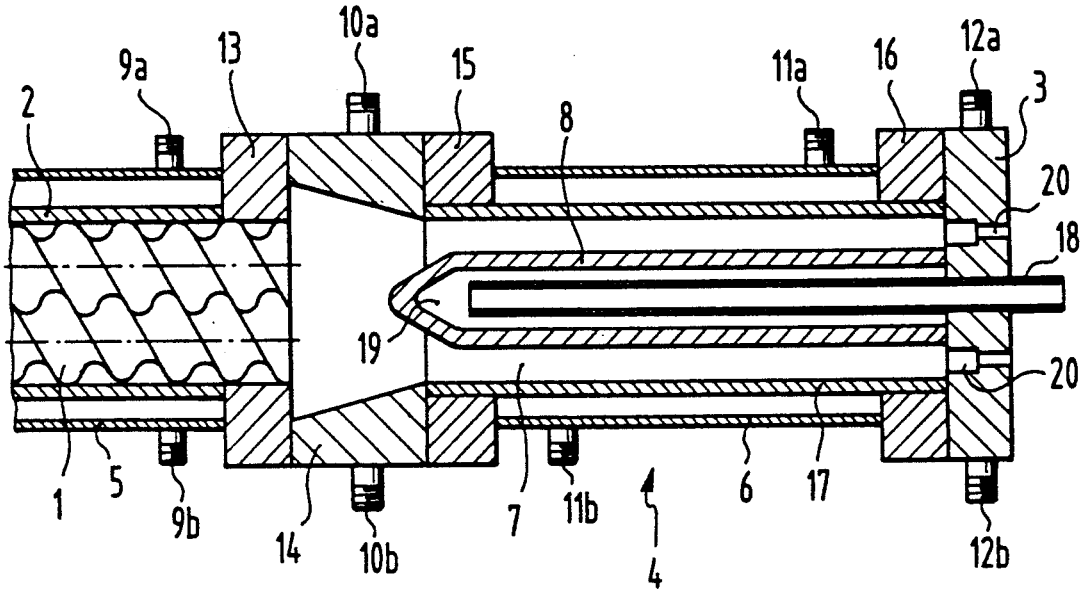
FIG. 1 is a diagrammatic sectional elevation of the discharge end of an apparatus according to the invention.

The apparatus according to the invention shown in FIG. 1 comprises a housing 2 in which a double screw 1 is supported for rotation. The presentation of FIG. 1 does not specifically show the entry zone of the extruder. At the end not illustrated in FIG. 1, the extruder comprises a filling opening preferably furnished with a metering device for feeding the starting materials of the propellant charge powder. Another metering device is provided for the addition of the solvent (ether and alcohol). The schematic build-up of the extruder is described, for example, in DE-OS 30 42 697 which is specifically referred to here in order to avoid repetitions.

The discharge end of the housing 2 is surrounded by a first cooling jacket 5 shown only in part in FIG. 1. The housing 2 is surrounded concentrically by the cooling jacket which has connections 9*a* and 9*b* serving as inlet and outlet, respectively, for a coolant, such as water.

Adjacent the housing 2 there is an intermediate plate 13 which, on the one hand, serves to support the double screw and, on the other hand, to close the housing 2 and the first cooling jacket 5. The plate 13 is followed by a transit member 14 whose task it is to convert the essentially eight-shaped flow cross section of the housing 2 in the range of the double screw 1 into a circular or slit-like cross section. Also the transit member 14 may have connections 10*a* and 10*b* through which a coolant may be supplied to a cooling jacket (not shown).

The transit member 14 is followed by a bearing plate 15 which, together with another bearing plate 16, supports a cylinder 17 that defines a passage 7 for the throughput of the propellant charge powder mixture. The passage 7 is surrounded by a second cooling jacket 6 provided with connections 11*a* and 11*b* serving as inlet and outlet, respectively, of a coolant.

The bearing plate 16 is followed by a die 3 or die plate likewise provided with connections 12*a* and 12*b* so that a coolant may be circulated through a cooling jacket not shown in FIG. 1. The die 3 may be of conventional design and comprise a retention plate, a screening device, and the like, such as described in DE-OS 30 42 662 to which reference is made here in order to avoid repetitions.

A cooling mandrel 8 is disposed centrally within the passage 7 which presents the principal part of the extruder head 4. The passage 7 may have a circular cross section, and then the cooling jacket 8, too, has a circular cross section. The cooling jacket 8 extends substantially for the full length of the passage 7 and has a cavity 19 in its interior. A pipe 18 opens into that cavity and cooling liquid may be passed through the same into the cooling mandrel 8. For the sake of simplification of the drawing, the connections for discharge of the coolant from the cooling mandrel 8 were not shown in FIG. 1.

Figure 2:
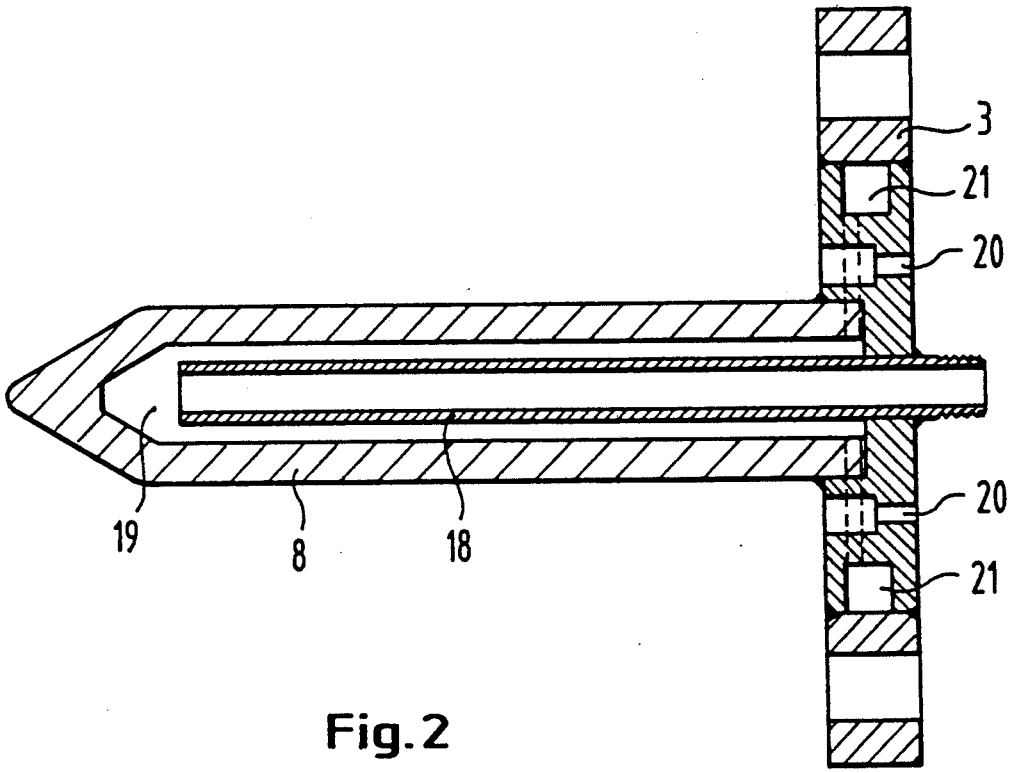
FIG. 2 is a sectional elevation of the cooling mandrel shown in FIG. 1.
Figure 3:
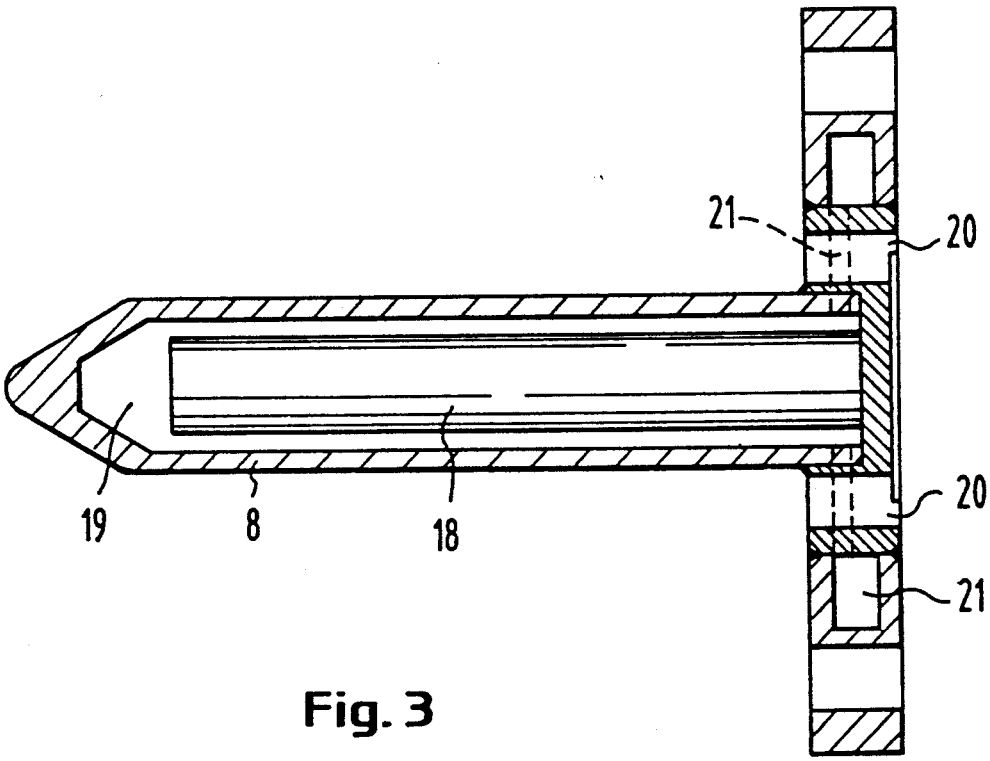
FIG. 3 is a sectional elevation of another embodiment of a cooling mandrel.

FIGS. 2 and 3 each show an embodiment of the cooling mandrel 8 according to the invention. As illustrated diagrammatically in FIG. 1, the embodiment of FIG. 2 includes a central pipe 18 through which coolant may be introduced into the cavity 19. The coolant is discharged through passages 21 which extend in radial direction in the die 3 or die retention plate and are arranged in such manner that they permit the coolant to pass between the die apertures 22.

In the embodiment illustrated in FIG. 3 the pipe 18 does not have an inlet opening. Instead, it is disposed as flow guide member in the cavity 19. The coolant is introduced and discharged through the passages 21.

Figure 4:
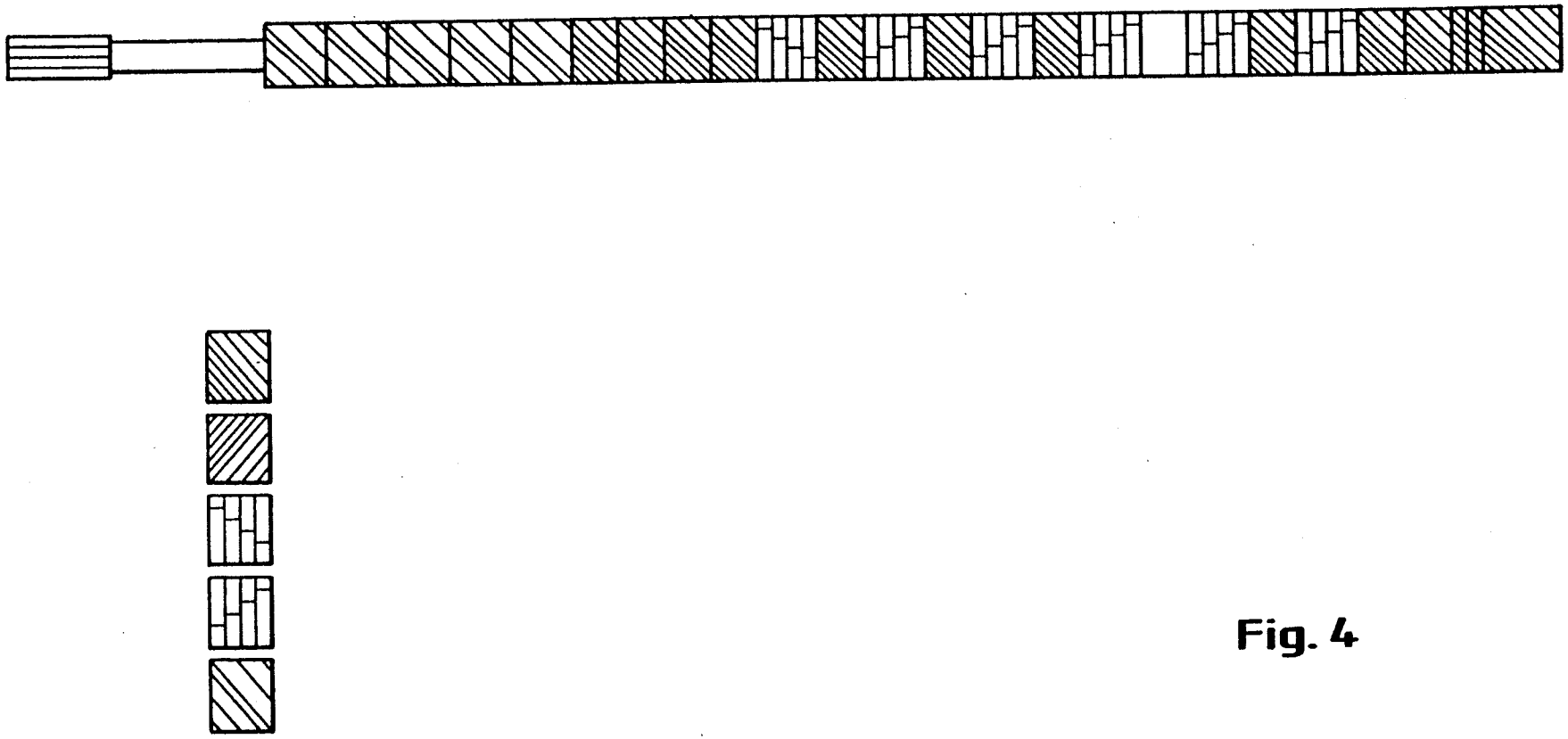
FIG. 4 is a diagrammatic presentation of the structure of an extruder screw.

FIG. 4 is a diagrammatic presentation of the structure of a screw according to the invention. It comprises a number of screw members rotating in clockwise sense as well as right and left kneading blocks and draw-in members. As shown in FIG. 4, there are five draw-in members to begin with in the direction of passage of the material, they are followed by four screw members rotating in clockwise sense. Next there is a right kneading block, followed by a screw member rotating in clockwise sense. This is followed by an alternating arrangement of a left kneading block and a screw member rotating in clockwise sense. The outlet end of the screw is constituted by five screw members rotating in clockwise sense.

Two examples will be given below to indicate process parameters and apparatus parameters of the method according to the invention and the apparatus used for practicing it.

EXAMPLE 1

Extrusion of B 6320 with alcohol/ether as solvents

| | |
|---|---|
| extruder structure: | |
| length of process portion: | 21 D |
| screw configuration: | no. 1 (FIG. 1) |
| die head: | |
| eight-to-round member (Werner & Pfleiderer) with cooling pipe (drawing no. 1) and die plate with cooling finger (drawing no. 2), 12 dies (D = 2.7; d = 0.45) | |
| extruder temperatures: | |
| housing 1 (metering of solids) | 35° C. |
| housing 2 (metering of solvents) | 35° C. |
| housing 3 | 25° C. |
| housing 4 | 25° C. |
| housing 5 | 10° C. |
| eight-to-round member | 10° C. |
| cooling pipe | 10° C. |
| die plate with cooling finger | 10° C. |
| test parameters: | |
| alcohol moisture of nitrocellulose | 21.5% |
| metering of: | |
| solids | 24 kg/h |
| ether | 13.1 l/h |
| alcohol | 1 l/h |
| rotational speed of extruder | 45 r.p.m. |
| temperature 1 (eight-to-round member) | 48–50° C. |
| temperature 2 (just before die plate) | 36–38° C. |
| head pressure | 33–35 bar |
| hydraulic pressure | 70–80 bar |
| The product is fully gelatinized. | |

EXAMPLE 2

Extrusion of D 698 with alcohol/ether as solvents

| | |
|---|---|
| extruder structure: | |
| length of process portion: | 21 D |
| screw configuration: | no. 1 (FIG. 1) |
| die head: | |
| eight-to-slit member (drawing no. 3) followed by die plate and two dies (D = 5.2; $TK_1$ = 3.0, d = 0.6) | |
| extruder temperatures: | |
| housing 1 (metering of solids) | 30° C. |
| housing 2 (metering of solvents) | 30° C. |
| housing 3 | 20° C. |
| housing 4 | 20° C. |
| housing 5 | 14° C. |
| eight-to-slit member | 14° C. |
| die plate | 14° C. |
| test parameters: | |
| alcohol moisture of nitrocellulose | 23.4% |
| metering of: | |
| solids | 12 kg/h |
| ether | 5.2 l/h |
| rotational speed of extruder | 32 r.p.m. |
| temperature 1 (beginning of 8-slit member) | 44–46° C. |
| temperature 2 (end of 8-slit member) | 33–35° C. |
| head pressure | 29–31 bar |
| hydraulic pressure | 60–64 bar |
| The product is homogeneous without any visible signs of non-gelatinized nitrocellulose. | |

The invention is not limited to the embodiments disclosed. Numerous changes and modifications may be made by a person skilled in the art without departing from the scope of the invention.

What is claimed is:

1. In a method of preparing monobasic propellant charge powders using alcohol and ether as solvents by an extrusion process using an extruder, the improvement comprising the step of cooling the propellant charge powder and solvent to a temperature range between about 35° C. and 40° C.

2. The method of claim 1, wherein said cooling is performed on said propellant charge powder and solvent downstream of said extruder.

3. The method of claim 1, wherein during said extrusion process, said extruder is operated in a substantially filled condition.

4. The method of claim 1, wherein extruder comprises at least one screw and the propellant charge powder and solvent is extruded using a low rotational speed of said screw.

5. The method of claim 1, wherein the alcohol content is between about 25% and 30%.

6. The method of claim 1, wherein said propellant charge powder has a high dinitrotoluene content and the alcohol content for the propellant charge powder having a high dinitrotoluene content is less than about 25%.

7. The method of claim 1, wherein the ether content is adjusted such that pressure at an outlet of said extruder ranges between about 25 and 35 bar.

* * * * *